United States Patent [19]

Woolgar

[11] 4,382,180

[45] May 3, 1983

[54] IMAGE INTENSIFIER DEVICES

[75] Inventor: Anthony J. Woolgar, Chelmsford, England

[73] Assignee: English Electric Valve Company Limited, Chelmsford, England

[21] Appl. No.: 43,469

[22] Filed: May 30, 1979

[30] Foreign Application Priority Data

May 30, 1978 [GB] United Kingdom ..... 25752/78

[51] Int. Cl.[3] ..... H01J 31/50; H01J 40/14

[52] U.S. Cl. ..... 250/213 VT

[58] Field of Search ..... 250/213 VT; 313/103 R, 313/104, 105 R, 106; 358/220, 223

[56] References Cited

U.S. PATENT DOCUMENTS

| | | | |
|---|---|---|---|
| 2,836,360 | 5/1958 | Adams | 313/105 |
| 3,665,247 | 5/1972 | Gordon | 250/213 VT |
| 3,976,874 | 8/1976 | Lange et al. | 250/213 VT |

*Primary Examiner*—Theodore M. Blum

*Attorney, Agent, or Firm*—Diller, Ramik & Wight

[57] ABSTRACT

The invention provides a multi stage image intensifier arrangement in which, for any stage, means are provided responsive to the photo current of the stage for discharging capacitance associated with that stage so as to limit the level of current density to which the anode screen of that stage is subjected as a result of a high intensity input flash of light.

8 Claims, 4 Drawing Figures

IMAGE INTENSIFIER DEVICES

This invention relates to image intensifier devices.

Typically an image intensifier consists of one or more stages each consisting essentially of a photo emissive cathode at an input end and a luminescent screen at the output end. Typically the luminescent screen consists of a phosphor layer having a backing layer of aluminium.

Figure 1:
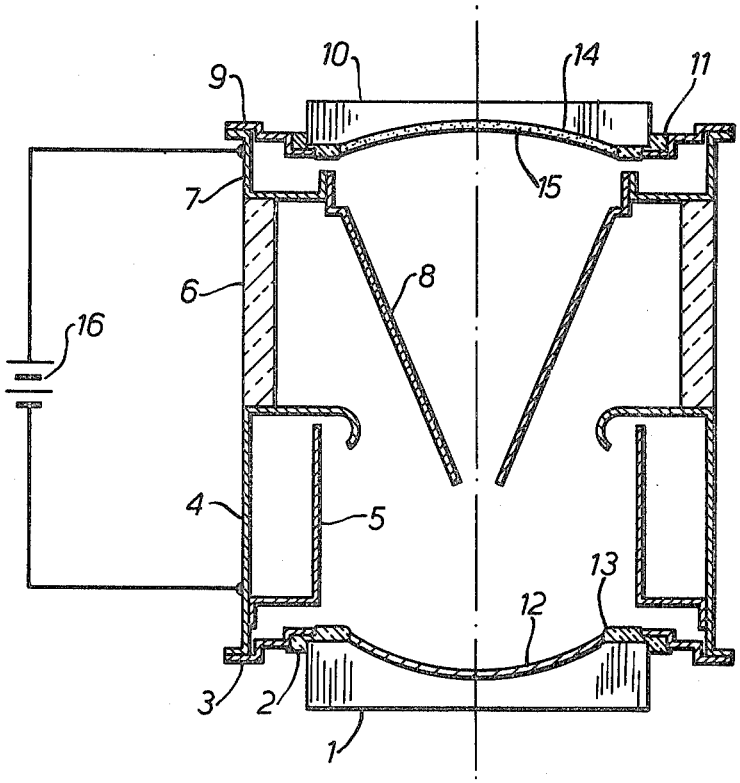

FIG. 1 of the accompanying drawings is a section through a typical image intensifier device as at present known. The device illustrated in FIG. 1 is a single stage device, but could form one module of a multi-stage image intensifier device.

Figure 2:
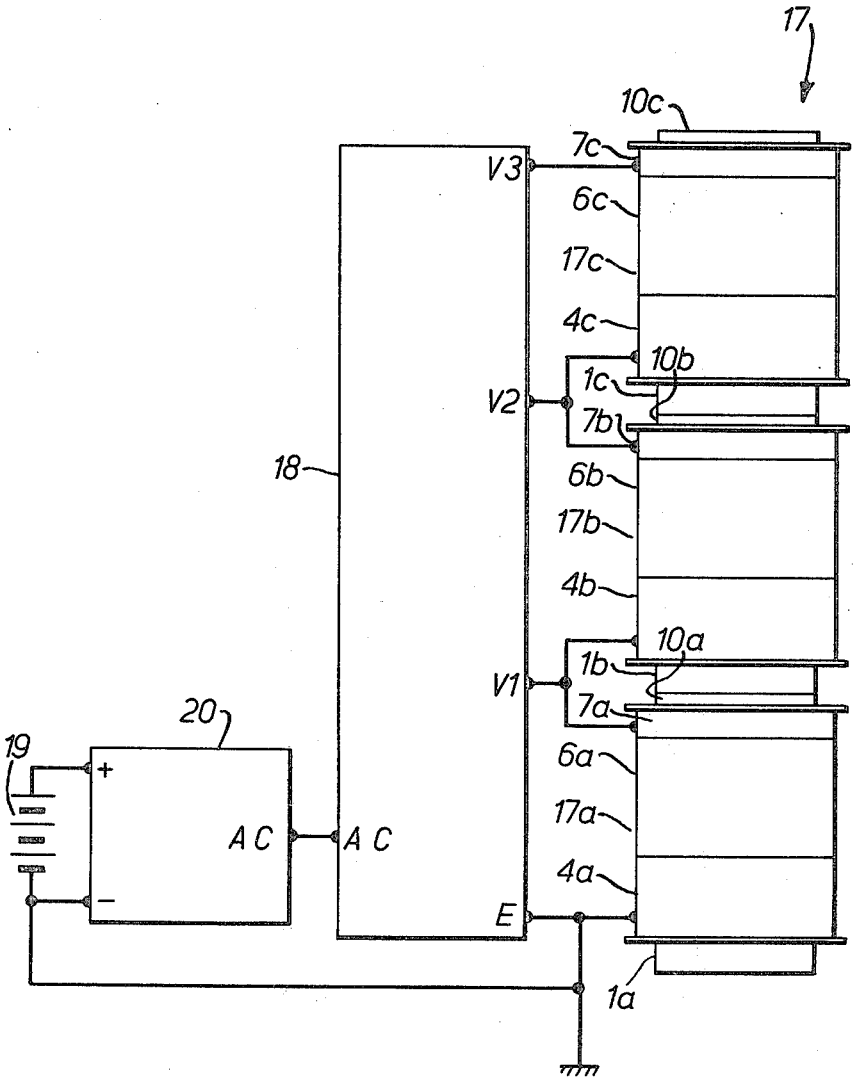
Figure 3:
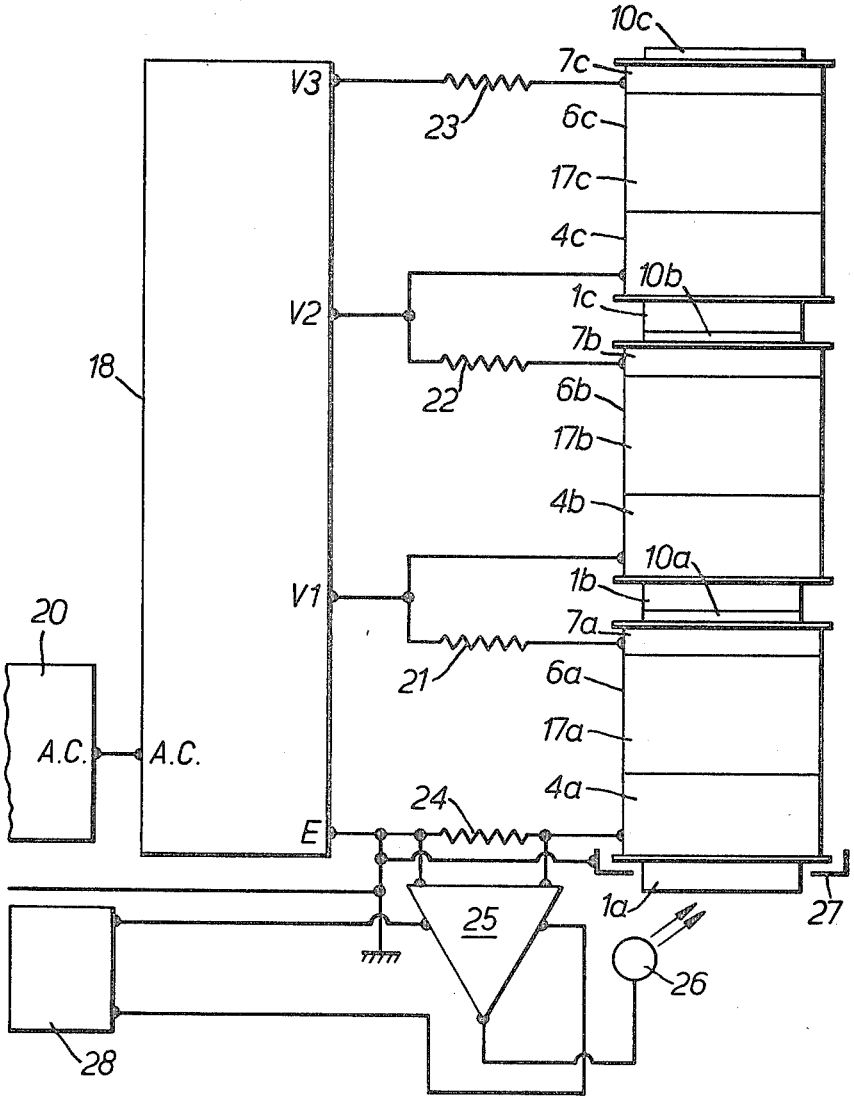
Figure 4:
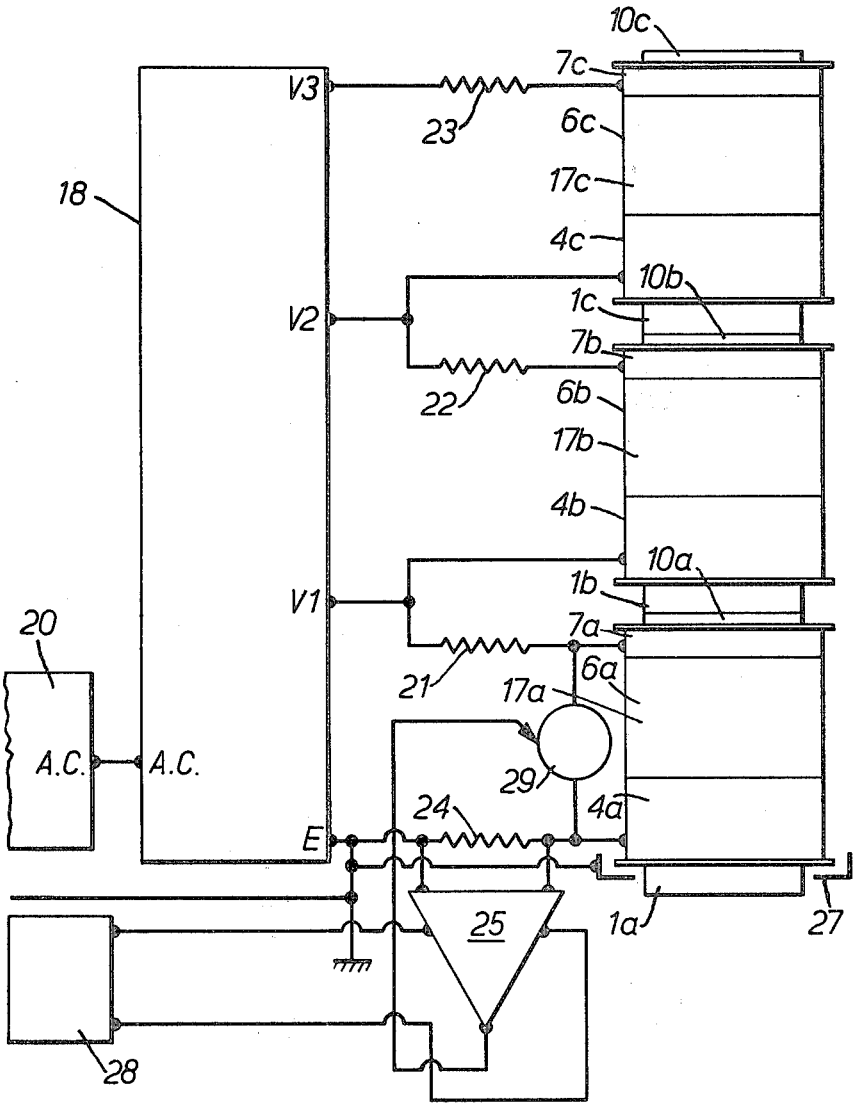

FIGS. 2–4 of the accompanying drawings illustrates a known three stage image intensifier each of the stages of which are individually as illustrated in FIG. 1, connected in a circuit arrangement.

Referring to FIG. 1, the device consists of a transparent input window 1, which, whilst the individual light fibres are not represented, is of the fibre optic type as known per se. The input window 1 is sealed by means of a glass frit seal 2 to a cathode input window mounting flange 3. The mounting flange 3 is carried from a cathode body housing 4. Electrically connected to the cathode body housing 4, and hence to the mounting flange 3, is a getter shield 5.

A glass or ceramic body insulator 6 separates the cathode body housing 4 from an anode body housing 7. The anode body housing 7 supports an anode focusing cone electrode 8, as known per se. Mounted in an anode output window or screen mounting flange 9 is a transparent output window 10, which is of the fibre optic type, although again the individual optic fibres are not represented. The window 10 is sealed to the mounting flange 9 by another glass frit seal 11.

At one end of the tube and carried by the transparent input window 1 is a photo-emissive cathode layer 12 provided with a peripheral photo-cathode metal contact layer 13, the latter making electrical contact with the mounting flange 3.

At the output end of the device and carried by the transparent output window 10 is a luminescent (phosphor) screen 14, which has an aluminium backing layer 15 electrically united with the mounting flange 9.

Operating potential difference is created between the housings 4 and 7 by means of a d.c. source represented at 16.

Referring to FIG. 2, the image intensifier tube 17 consists of three stages 17*a*, 17*b* and 17*c*, each of which is individually as illustrated in FIG. 1 and corresponding references are used for corresponding parts, but with the appropriate suffixes a, b or c. Thus, the input cathode window of the three stage intensifier is 1*a* and the final output display window is 10*c*.

A power supply in the form of an extra high tension multiplier rectifier assembly 18 is provided to supply high tension across the stages 17*a*, 17*b* and 17*c* of the device 17 from four supply points referenced "E", "V1", "V2" and "V3". The point E is at system earth potential. The potential difference between point V1 and point E is 12 kV, the potential difference between point V2 and point E is 27 kV and the potential difference between point V3 and point E is 42 kV. The rectifier assembly 18 is itself supplied from a d.c. supply 19 via an inverter 20.

Point E is connected to cathode body housing 4*a* of intensifier module 17*a*, whilst the anode body housing 7*a* of that module together with the cathode body housing 4*b* of module 17*b* is connected to point V1. The anode body housing 7*b* of module 17*b* together with the cathode body housing 4*c* of module 17*c* is connected to point V2. The anode body housing 7*c* of module 17*c* is connected to point V3.

When such an image intensifier is exposed to very bright flashes of light a high energy density pulse of electrons is generated at the photo cathode, which can cause irreparable damage to the phosphor screen leaving this permanently scarred. Where the phosphor screen consists of a layer of phosphor with a backing layer of aluminium, quite commonly the energy density in the pulse of electrons causes the aluminium backing layer locally to melt.

One object of the present invention is to provide an improved image intensifier arrangement, single or multi staged, in which the above difficulty is reduced.

According to this invention an image intensifier arrangement is provided including at least one stage and means are provided responsive to the photo current of said stage for discharging capacitance associated with that or another stage, whereby to limit the level of current density to which the anode screen of said last mentioned stage is subjected as a result of a high intensity input flash of light.

Normally said last mentioned stage and said first mentioned at least one stage will be the same stage.

Said responsive means may comprise a resistance in the supply path for operating potential to the photo cathode of a stage or to the anode screen of a stage, preferably the former.

Preferably an a.c. coupled amplifier is connected across said last mentioned resistor and is arranged to trigger an active device provided to discharge said capacitance as aforesaid.

In one embodiment of the invention said active device comprises means for providing illumination for the photo cathode of a stage the associated capacitance of which is to be discharged, in which case preferably a resistor is connected in the supply path for operating potential to the anode screen of that stage.

Said illuminating means may be provided external of the envelope of that stage or within the envelope of a stage. In either case said illumination means may be arranged to provide front or back illumination of the photo cathode of a stage.

Said illumination means may comprise one or more high speed flash tubes, light emitting diodes or laser diodes. Said illumination means may also be arranged to illuminate a photo cathode from outside of the tube envelope via a transparent section or transparent sections of the tube envelope.

In another embodiment of the invention, said active device is a high voltage switching device connected between the photo cathode and the anode screen of a stage.

Preferably in this case said device comprises one or more high speed switching devices of any convenient type such as gas filled switching tubes thyristors or transistors.

In all cases where said image intensifier is a multi stage image intensifier, preferably said responsive means is provided to be responsive to the photo current of said first stage and said capacitances discharging means is provided in respect of at least that first stage.

Preferably in all cases said arrangement is also in accordance with the invention in our co-pending application No. I/6190/V except that whilst the anode screen, or each of the anode screens in the case of a multi stage image intensifier, may be in accordance with the invention in our co-pending U.K. application No. 23754/78 there is less advantage to be obtained in thus providing the screen or screens with an arrangement in accordance with the present invention.

Preferably, but not essentially, the image intensifier is of the diode type.

The invention is further described with reference to FIGS. 3 and 4 of the accompanying drawings which illustrate two examples of three stage image intensifier arrangements in accordance with the present invention.

The arrangement illustrated in FIG. 3 differs from that illustrated in FIG. 2 in a number of respects. Firstly, it will be noted that resistors 21, 22 and 23 are introduced between the anode mounts *7a*, *7b* and *7c* and the supply points V1, V2 and V3 of the rectifier assembly 18. These resistors 21, 22 and 23 are provided in accordance with the invention in our aforesaid co-pending application Ser. No. 43,468, which reference may be made for additional information concerning this aspect of the circuit arrangement.

In addition, a resistor 24 of value 1 MΩ is connected between the cathode body housing 4*a* of the first stage 17*a* and the supply point E of the rectifier assembly 18. Supply point E is, of course, at earth potential.

Connected across the resistor 24 is an a.c. coupled pulse amplifier 25, which detects current flowing through the resistor 24. The amplifier 25 is connected to energise a light source represented at 26 (which may consist of one or more high speed flash tubes, light emitting diodes or laser diodes) positioned to flood the cathode input window 1*a* of the first stage 17*a* of the intensifier.

Depending upon the construction and application of the image intensifier, it may be necessary to provide an isolated (earth) return contact for the power supply and this is represented at 27.

An auxiliary power supply source for the amplifier 25 and the light source 26 is represented at 28.

In operation, a high energy flash passing through the intensifier from the input window 1*a* will cause a pulse of photo current to flow through the resistor 24. The photo current pulse passing through resistor 24 produces a rapidly rising voltage, which is amplified by the a.c. coupled amplifier 25. The output of amplifier 25 is arranged to trigger the light source 26 on the rising edge of the photo current pulse through resistor 24. At the time when the light source 26 is triggered, the photo current is still relatively low, although rising. Triggering light source 26 illuminates a substantial area of the photo cathode of the first stage 17*a*. This causes photo current to flow, which would be large enough to produce a potential across resistor 21 which is many times greater than (V1−E). This photo current is also sufficient to discharge the self plus stray capacitance of the first stage 17*a* of the image intensifier before the photo current caused by an initiating external flash can give rise to a dangerous level of current density (viz several hundreds of micro-amperes per square millimeter for periods of the order of one millisecond.). Ideally the whole of the photo cathode of the first stage 17*a* is illuminated by the light source 26, but it is sufficient if the electron beam energy is spread out over an area of the screen at a level below the critical energy density at which damage can be expected.

In the embodiment illustrated in FIG. 3, the light source 26 is shown as external and arranged to illuminate the front of the photo cathode of the first stage 17*a* through cathode input window 1*a*. In the modifications which are not illustrated, a light source or light sources are provided within the envelope of the tube and provide rear illumination of the photo cathode 1*a*. In other embodiments, back illumination is afforded by light sources through the section of insulator 6*a*, which is formed of glass, from outside of the envelope. In other embodiments the photo cathodes of stages 17*b* and 17*c* are also provided to be illuminated.

The arrangement should be such that the time taken to recharge the first stage 17*a* to its operating potential is longer than a typical flash to be expected in operation and the triggering circuits controlling the triggering of light source 26 should also be capable of recharging and resetting during a similar short period.

Referring to FIG. 4, as with FIG. 3 a resistor 24 is connected between the cathode body housing 4*a* and supply point E of the rectifier assembly 18, which supply point is again at earth potential. Also connected across the resistor 4 is an a.c. coupled pulse amplifier 25, which operates as before when a flash of light is received by the photo cathode of stage 17*a*. In this case, however the output of amplifier 25 is arranged to trigger a high voltage switching device 29 on the rising edge of the photo current pulse through resistor 24. This triggers device 29 into conduction, which by virtue of it being connected between the cathode mount 4*a* and the anode screen mount 7*a* discharges the self plus stray capacitance of the first stage 17*a* before the initiating external flash can give rise to dangerous levels of current density.

Unlike the arrangement of FIG. 3, the current passed by device 29 to discharge the self plus stray capacitance of the first stage 17*a* dissipates the stored energy externally and not in the intensifier screen itself.

In this particular case, switching device 29 consists of one or more gas filled switching tubes. In practice, the device 29 would be miniaturised and encapsulated with the image intensifier itself during assembly.

Again whilst not illustrated, devices corresponding to 29 are, in modifications, connected across the stages 17*b* and/or 17*c* in addition.

I claim:

1. An image intensifier arrangement including at least one stage and means responsive to the photo current of said stage for discharging capacitance associated with that or another stage, whereby to limit the level of current density to which the anode screen of said last mentioned stage is subjected as a result of a high intensity input flash of light, wherein said responsive means comprises a resistance in a supply path for operating potential to either the photo cathode or the anode screen of a stage, an a.c. coupled amplifier connected across said resistance and providing an output, and an active device triggerable by said amplifier output to discharge said capacitance as aforesaid.

2. An arrangement as claimed in claim 1 and wherein said responsive means comprises a resistance in the supply path for operating potential to the photo cathode of the first stage.

3. An arrangement as claimed in claim 1 and wherein said active device comprises means for illuminating the photo cathode of a stage the associated capacitance of which is to be discharged.

4. An arrangement as claimed in claim 3 and wherein said illuminating means is provided external of the envelope of the stage, and is arranged to illuminate the front of the photo cathode of the stage.

5. An arrangement as claimed in claim 3 and wherein said illuminating means comprises one or more high speed flash tubes, light emitting diodes, or laser diodes.

6. An arrangement as claimed in claim 1 and wherein said active device is a high voltage switching device connected between the photo cathode and the anode screen of a stage.

7. An arrangement as claimed in claim 6 and wherein said active device comprises one or more gas filled switching tubes, thyristors, or transistors.

8. An arrangement as claimed in claim 1 and wherein said image intensifier is a multi stage image intensifier and said responsive means is provided to be responsive to the photo current of said first stage and said capacitance discharging means is provided in respect of at least that first stage.

* * * * *